US010173858B2

(12) United States Patent
Vulpitta et al.

(10) Patent No.: US 10,173,858 B2
(45) Date of Patent: Jan. 8, 2019

(54) ADHESIVE TAPE DISPENSER FOR FOLDED EDGE TAPE

(71) Applicant: SHURTECH BRANDS, LLC, Avon, OH (US)

(72) Inventors: Brian A. Vulpitta, Avon Lake, OH (US); Daniel E. Festa, Strongsville, OH (US); William F. DeWitt, Hickory, NC (US); Aaron A. Misener, Chagrin Falls, OH (US); Curtis P. Taylor, Chagrin Falls, OH (US)

(73) Assignee: SHURTECH BRANDS, LLC, Avon, OH (US)

( * ) Notice: Subject to any disclaimer, the term of this patent is extended or adjusted under 35 U.S.C. 154(b) by 0 days.

(21) Appl. No.: 14/907,143

(22) PCT Filed: Jul. 22, 2014

(86) PCT No.: PCT/US2014/047685

§ 371 (c)(1),
(2) Date: Jan. 22, 2016

(87) PCT Pub. No.: WO2015/013325

PCT Pub. Date: Jan. 29, 2015

(65) Prior Publication Data

US 2016/0159604 A1 Jun. 9, 2016

Related U.S. Application Data

(60) Provisional application No. 61/856,908, filed on Jul. 22, 2013.

(51) Int. Cl.

| | |
|---|---|
| ***B65H 35/00*** | (2006.01) |
| ***B65H 37/06*** | (2006.01) |
| ***B65H 45/22*** | (2006.01) |

(52) U.S. Cl.
CPC ..... *B65H 35/0033* (2013.01); *B65H 37/06* (2013.01); *B65H 45/22* (2013.01); *Y10T 156/1795* (2015.01); *Y10T 225/282* (2015.04)

(58) Field of Classification Search
CPC B65H 35/0033; B65H 35/002; B65H 35/004; B65H 45/22; Y10T 156/1795;
(Continued)

(56) References Cited

U.S. PATENT DOCUMENTS

| | | | | |
|---|---|---|---|---|
| 1,708,725 A * | 4/1929 | Huempfner | ..... | B65H 35/0046 118/43 |
| 2,309,093 A * | 1/1943 | Borden | ..... | B65H 35/0046 156/465 |
| 2,581,190 A * | 1/1952 | Hodges | ..... | B65H 35/002 225/6 |

(Continued)

FOREIGN PATENT DOCUMENTS

| | | | | |
|---|---|---|---|---|
| DE | 19705859 A1 * | 8/1998 | ..... | B65H 35/0026 |
| JP | 2004315203 A * | 11/2004 | ..... | B65H 35/0026 |

(Continued)

*Primary Examiner* — Laura M Lee
(74) *Attorney, Agent, or Firm* — Fay Sharpe LLP

(57) ABSTRACT

An adhesive tape dispenser and applicator which folds one or both edges of tape being applied over upon themselves. The dispenser includes an edge folding guide having a planar surface, two inwardly converging edges and tape guides cooperating to fold the edges of the tape. A compression roller is provided to press the edges together. A method of threading tape onto an edge folding tape dispenser is also described.

22 Claims, 7 Drawing Sheets

(58) Field of Classification Search
CPC ..... Y10T 156/18; Y10T 156/1788; Y10T 156/1348; Y10T 156/1365; Y10T 225/282
USPC ..... 156/200, 463, 465, 459, 574, 577; 225/90
See application file for complete search history.

(56) References Cited

U.S. PATENT DOCUMENTS 2,899,198 A * 8/1959 Borden ..... B65H 35/0006 493/357
4,576,674 A * 3/1986 Le Tarte ..... B31F 1/0029 156/463
4,759,819 A * 7/1988 Ingram ..... B65B 51/06 156/443
6,152,344 A * 11/2000 Jensen ..... B65H 35/0026 225/12
9,493,322 B1 * 11/2016 Lam ..... B65H 35/0033
9,540,207 B1 * 1/2017 Chen ..... B65H 37/005
2002/0056526 A1 * 5/2002 Kelders ..... B65H 35/0033 156/577
2004/0238109 A1 * 12/2004 Gonzalez ..... B65H 35/0026 156/227
2006/0118245 A1 * 6/2006 Imazeki ..... B65H 35/0033 156/510
2010/0084450 A1 4/2010 Vulpitta
2012/0097334 A1 * 4/2012 Lam ..... B31D 1/0062 156/350
2016/0122151 A1 * 5/2016 Vulpitta ..... B65H 35/0033 225/56

FOREIGN PATENT DOCUMENTS

JP 2004331296 A * 11/2004 ..... B65H 35/0033
JP 2006168983 A * 6/2006 ..... B65H 35/0026

* cited by examiner

ADHESIVE TAPE DISPENSER FOR FOLDED EDGE TAPE

CROSS-REFERENCE TO RELATED APPLICATIONS

This application claims priority to U.S. Provisional Patent Application Ser. No. 61/856,908, filed on Jul. 22, 2013. This application is incorporated herein by reference in its entirety.

FIELD OF THE DISCLOSURE

The present invention relates generally to dispensers and applicators for adhesive tape and more particularly to a dispenser and applicator which folds a portion of the edge of the length of tape upon itself while dispensing.

BACKGROUND OF THE DISCLOSURE

Adhesive tape is used in business settings and home settings for a variety of purposes. Adhesive tape is used in sealing boxes for shipping. Adhesive tape is used in masking surfaces in painting operations. Adhesive tape is temporarily or permanently used to repair items or bind items together for storage or other purposes. Adhesive tape for use in these situations is frequently comprised of a long substrate of paper, plastic or other film-like materials of generally uniform width and adhesive coated onto one or both sides of the substrate. Such lengths of tape are often rolled upon a core of paper, plastic or other suitable material. The users of such tape frequently buy them premounted on a dispenser or mount them on a dispenser for use in storing the tape, dispensing the tape and sometimes applying the tape to the intended workpiece.

It is sometimes advantageous to fold over one or both edges of a length of adhesive tape before applying it to the intended workpiece. In other situations, a folded edges of a tape provides a desired effect for an edge in a painting operation. In still other situations, a folded edge provides a grasping portion available when one intends to remove the tape from the temporary position after it has served its function. These and other advantages of folding the edge of the tape are known in the art.

Attempts have been made to provide tape dispensers which fold the edge of an adhesive tape length as it is dispensed from a roll. Some such dispensers are adapted for use with masking tape used in painting operations. Some such dispensers are complex to manufacture, have a high part count, and are expensive. Moreover, such tape dispensers are difficult to use and difficult to thread.

SUMMARY OF THE DISCLOSURE

In accordance with the present disclosure, a tape dispenser for dispensing adhesive tape with one longitudinal edge or both longitudinal edges folded over upon itself is described.

The tape dispenser of the present disclosure generally comprises a first side wall with a forward end, a rearward end, a top edge and hub portion facing a second side wall having a forward end, a rearward end, a top edge and a hub portion near its rearward end; a connecting portion extending between the two side walls, and connecting the side walls in a generally parallel relationship; a cutter adjacent the forward end of the dispenser and extending between the two side walls; an edge folding guide having a first generally planar surface against which the non-adhesive side of a length of tape may engage, an inwardly facing surface generally perpendicular to the first generally planar surface with this inwardly facing surface converging toward the center line of the tape dispenser from its end near the hub its end near the cutter and a guide member adjacent the inwardly facing surface, the guide member, the inwardly facing surface, and the first generally planar surface defining a guide slot adapted to engage one of the edges of the length of tape being dispensed and fold that edge into a longitudinal fold with portions of the adhesive bearing surface confronting one another; and, a compression element between the guide slot and the cutter adapted to apply pressure to the lengths of tape bringing the confronting adhesive surface portions into contact as the tape is dispensed.

Further in accordance with the disclosure, the edge folding guide has a proximal end closer to the cutter and a distal end remote from the cutter; the edge folding guide is rotatable with respect to the first and second side walls about an axis generally parallel to the cutter and adjacent the proximal end of the edge folding guide; a first guide roller is mounted on the edge folding guide adjacent its distal end whereby the edge folding guide may be rotated into a tape threading position allowing a length of tape to be threaded into engagement with the first guide roller and made available to the guide slot and rotated into a dispensing position for dispensing lengths of tape with folded edges.

Still further in accordance with the disclosure, the edge folding guide may be releasably locked in the dispensing position by means of one or two bosses mounted at the ends of the guide roller.

Still further in accordance with the disclosure, the dispenser is generally symmetrical about a central plane thus providing one guide slot for each edge of the tape whereby both edges of the tape may be folded and compressed in a dispensing operation.

It is an object of the present disclosure to provide a tape dispenser which will fold one or both edges of an adhesive tape length being dispensed as it is applied to a workpiece which is easy to use and easy to thread.

It is another object of the present disclosure to provide a tape dispenser which will fold one or both edges of a length of adhesive tape whose operation is easy to understand.

It is yet another object of the present disclosure to provide a tape dispenser which will fold the edge of the adhesive tape being dispensed which is easy to thread.

It is still another object of the present disclosure to provide a tape dispenser having an appearance which is generally familiar to consumers and is therefore readily understood and used by consumers in dispensing a piece of tape.

It is still another object of the present disclosure to provide an adhesive tape dispenser which will fold the edges of adhesive tape as dispensed and applied which is inexpensive to manufacture.

Further objects and advantages of the disclosure will be apparent from the following detailed description of a preferred embodiment taken together with the accompanying drawings.

DETAILED DESCRIPTION

The description and drawings herein are merely illustrative of the disclosure and various modifications, changes, and alterations can be made in the structures disclosed without departing from the scope of the disclosure.

Figure 3:
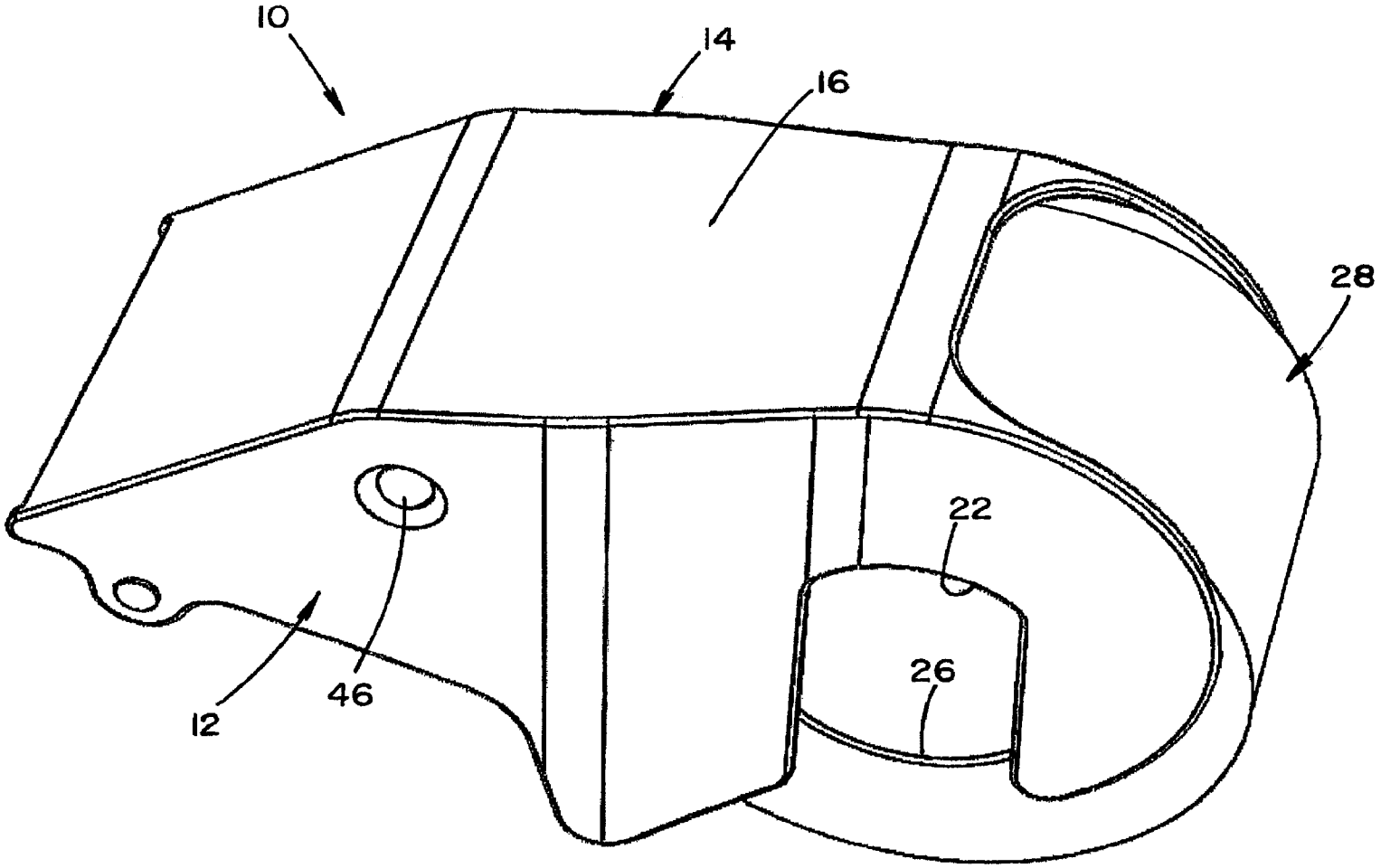
FIG. 3 is a perspective top view of the tape dispenser shown in the same configuration as FIG. 1.
Figure 4:
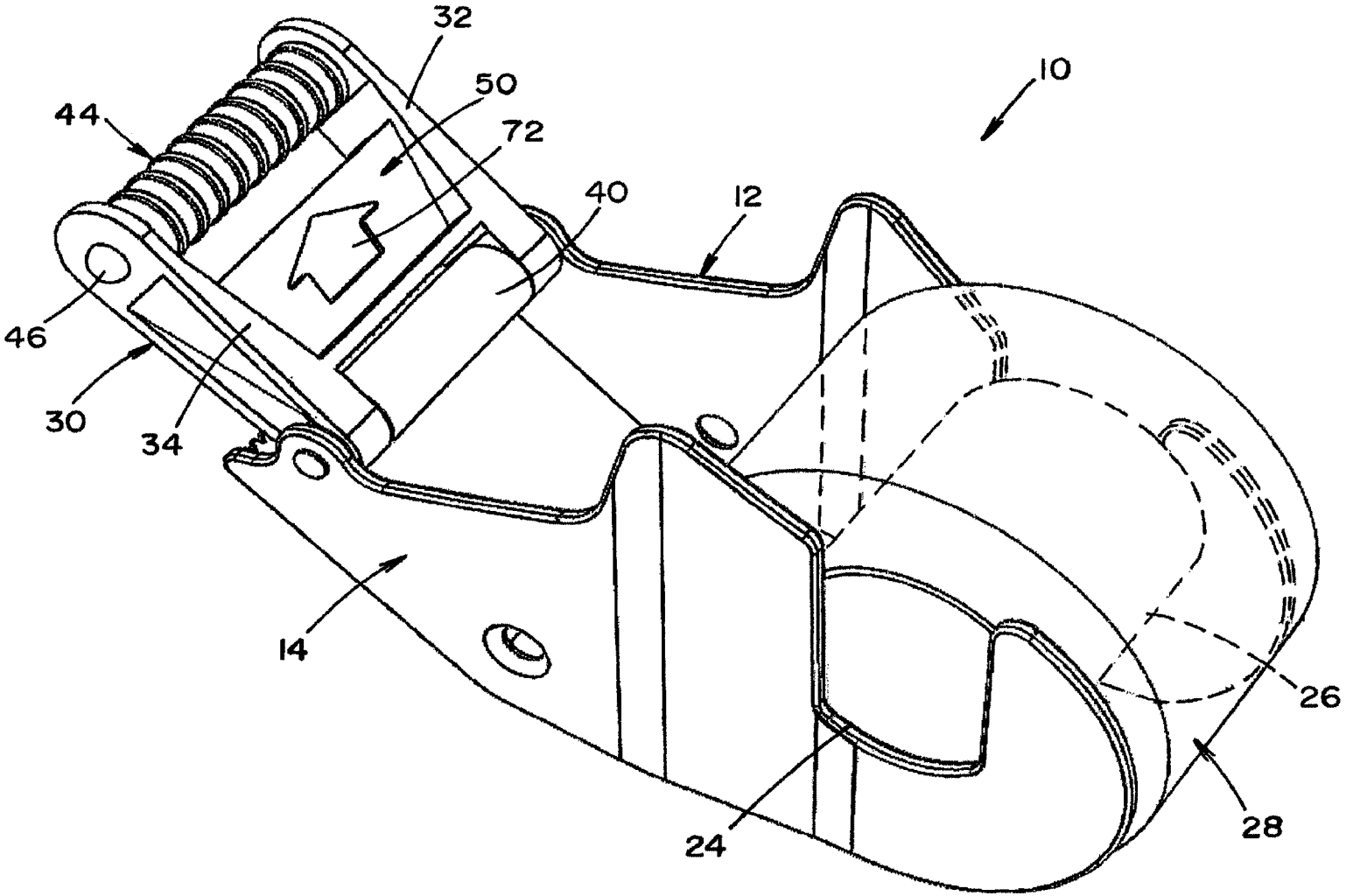
FIG. 4 is a view similar to FIG. 2 emphasizing the threading location used in threading the tape from a roll of tape through the edge folding guide.

Referring now to the figures, a tape dispenser 10 has a first side wall 12, a second side wall 14, a connecting portion 16 (FIG. 3) and a cutter 18. The first side wall 12 and the second side wall 14 are generally parallel to one another and mirror images of one another. The structure of these major elements is generally conventional and familiar to consumers.

"Generally parallel" is used herein to describe surfaces and planes which are parallel to one another and also which divert from parallel slightly to accommodate molding and design. Similarly, "perpendicular" is used to include two lines or planes at right angles to one another and two lines or planes having an intersecting angle close to 90° but being slightly greater or smaller than 90° to allow for divergence to accommodate molding (draft) or otherwise accommodate manufacturing or design. "Proximal" is used to identify something closer to a given reference than something else. "Distal" is used to identify something further from a reference than something else. "Between" is used to describe a thing operatively or physically after a first element and before a second element. Thus, a second roller may be "between" a first roller and a third roller even if, physically, it is to the left of both the first roller and third roller but a length of tape engages the rollers in the order first, second, then third. Unless otherwise clear from context, "proximal" is used to describe close to the cutter end of the tape dispenser and "distal" is used to describe something remote from the cutter end of the tape dispenser.

Referring again to FIG. 1, the first side wall 12 has a hub portion 22 near the distal end of the tape dispenser. The hub portion 22 includes a flange extending inwardly from the first side wall 12 (inwardly referring to towards the second side wall 14). A second hub portion 24 is in a similar position on the second side wall 14. The two hub portions 22, 24 rotatably support the core 26 of a roll of adhesive tape 28.

The first side wall 12 and the second side wall 14 are mirror images of one another.

An edge folding guide 30 is rotatably mounted between the first side wall 12 and the second side wall 14 near the cutter 18. The edge folding guide 30 is rotatable about an axis parallel to the cutting edge of the cutter 18. The edge folding guide 30 is rotatable between a dispensing position in which the edge folding guide 30 is locked into position not only between the two side walls but flanked by the side walls as seen in FIG. 1 and a tape threading position in which the edge folding guide 30 is, for the most part, not flanked by the side walls 12, 14 but extending outside of the side walls between the planes of the side walls as seen in FIG. 2.

Figure 1:
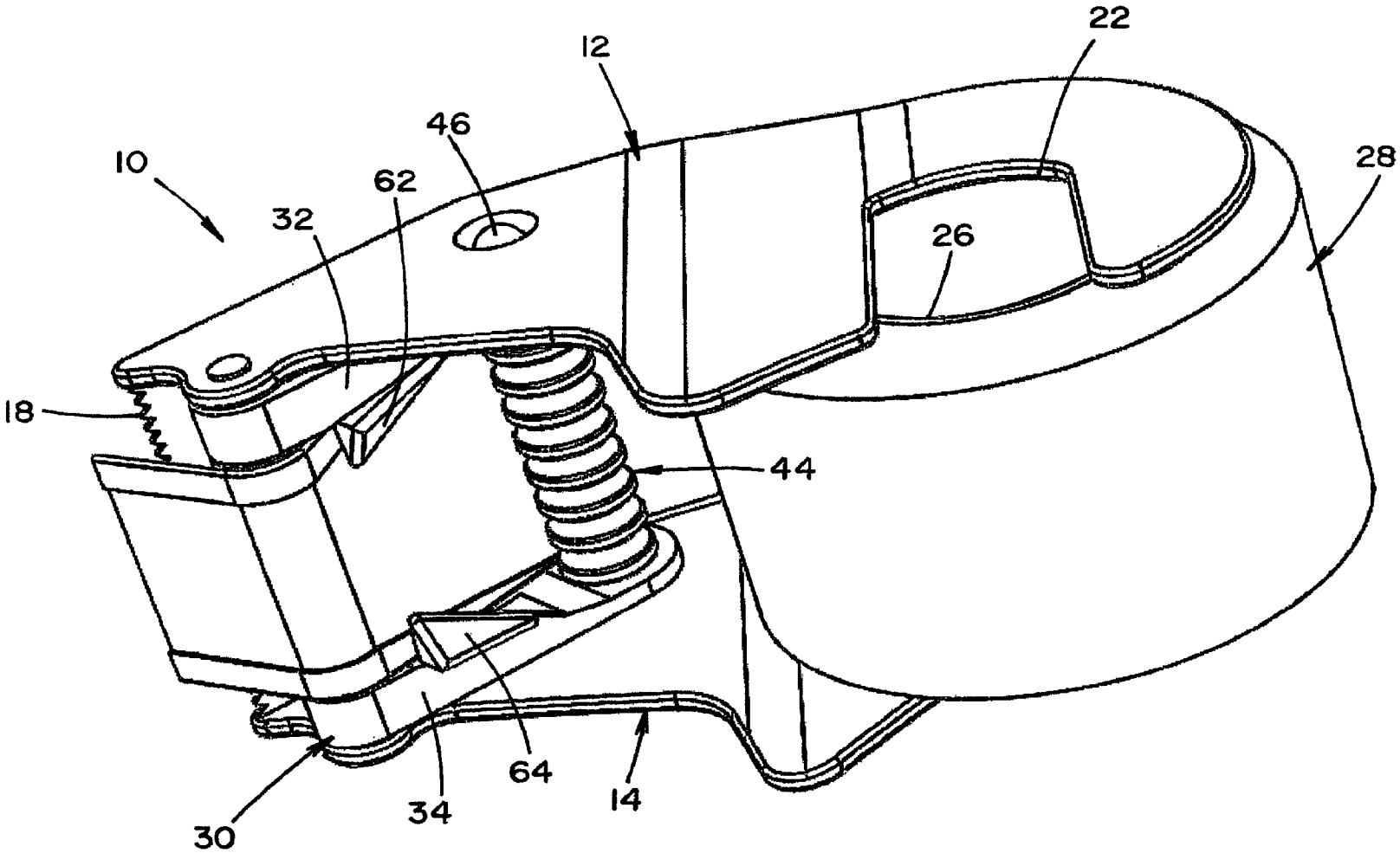
FIG. 1 is a perspective view of the tape dispenser in accordance with the disclosure looking from the bottom with a roll of transparent tape mounted in the dispenser and threaded through the dispenser.
Figure 2:
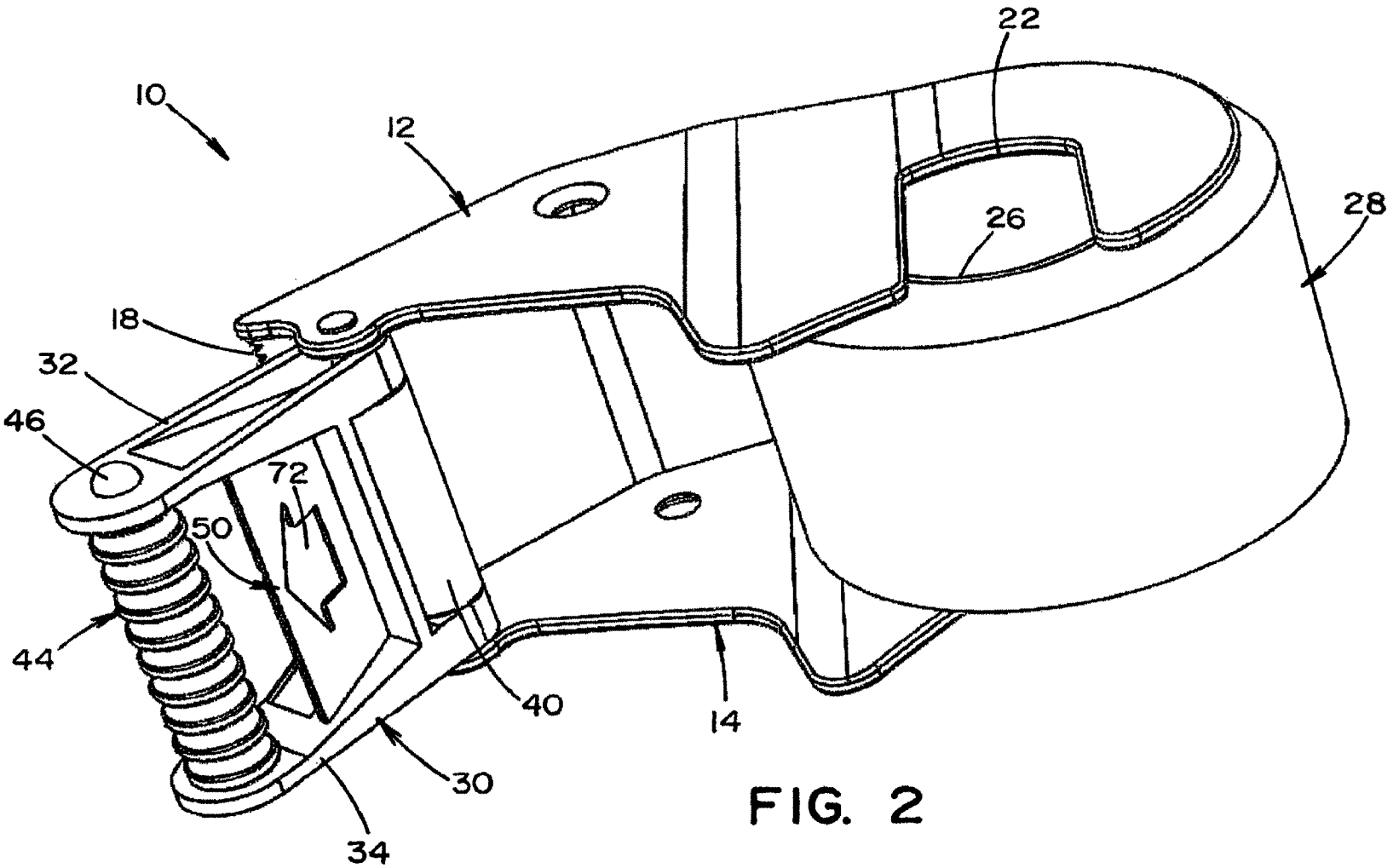
FIG. 2 is a view similar to FIG. 1 with the edge folding guide in the threading position.
Figure 5:
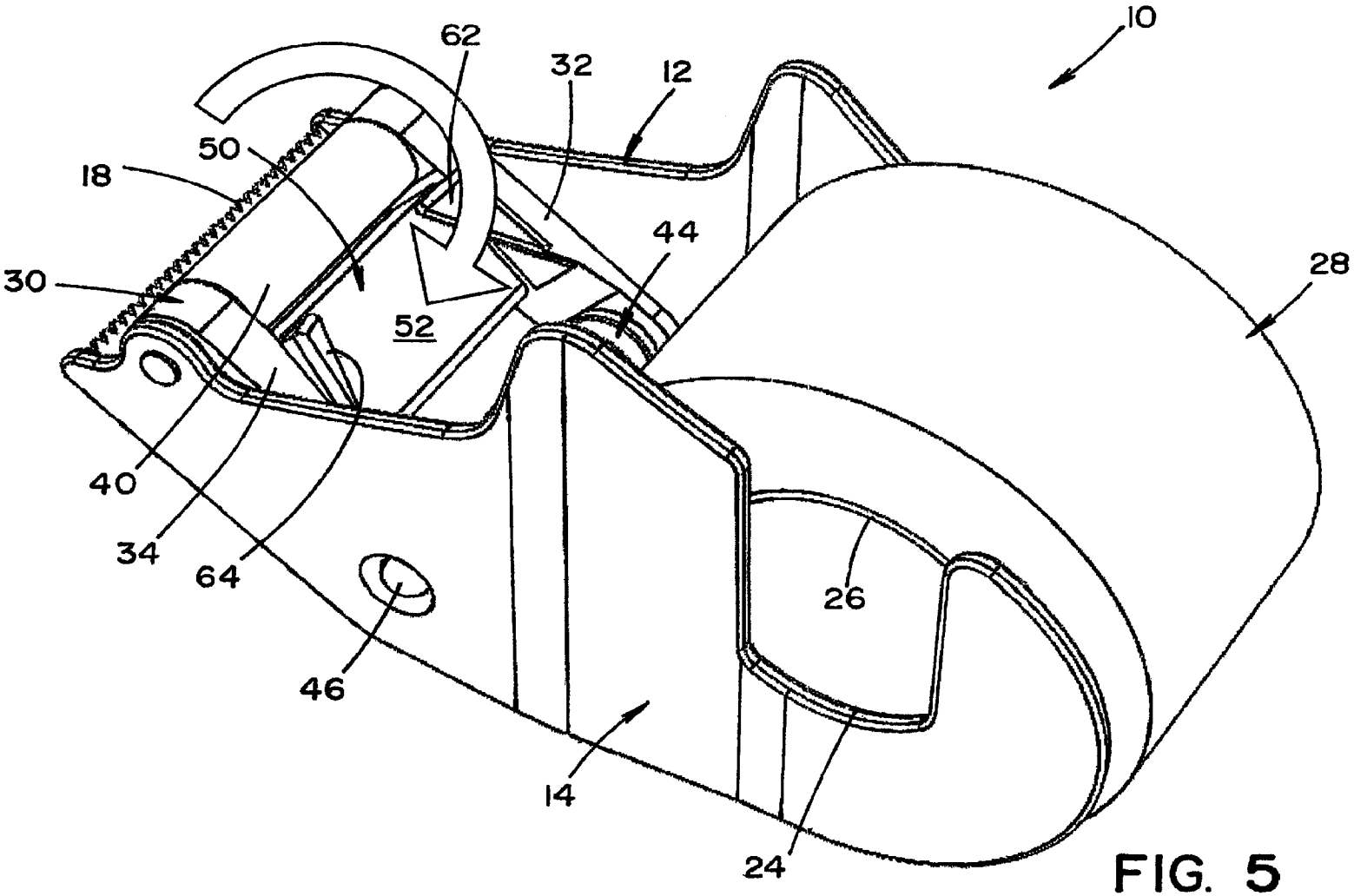
FIG. 5 is a view similar to FIG. 4 showing the edge folding guide rotated back into the dispensing position and locked in place.

With reference to FIGS. 5 and 1, the edge folding guide 30 is seen in the dispensing position.

The edge folding guide 30 is generally symmetrical about a central plane. The edge folding guide has a first side bar 32 and a second side bar 34. The first side bar and the second side bar are generally mirror images of one other. The first side bar 32 and the second side bar 34 have aligned circular holes at their proximal end closer to the cutter 18. A compression roller 40 has a cylindrical portion of a first diameter contained between the proximal end of the first side bar 22 and the proximal end of the second bar 34. Reduced diameter portions extend from each end of the central portion of the compression roller 40. These reduced diameter portions pass through circular apertures in the proximal ends of the first side bar 32 and the second side bar 34 and into circular apertures in the first side wall 12 and the second side wall 14. The compression roller 40 and the edge folding guide 30 are rotatably mounted to the tape dispenser body by means of the compression roller 40 extensions passing through these apertures. Because the side walls 12, 14 are fabricated as by injection molding from a polymer material, the side walls can be spread apart sufficiently to allow assembly of these elements through the apertures in the side walls 12 and 14. Alternatively, a wiper integral with the edge folding guide can replace the compression roller 40. In this arrangement, the wiper has a smooth curved downwardly facing surface (as seen in FIG. 1) but does not rotate when tape is dispensed.

The distal end of the first side bar 32 and the distal end of the second side bar 34 have aligned circular holes which accept the end portions of a first guide roller 44. The first guide roller 44 is generally cylindrical with a crenelated outer surface to minimize the area of contact with tape. Additionally, the first guide roller has extensions 46 of reduced diameter at each of its ends. The extensions 46 pass through circular openings in the first side bar 32 and the second side bar 34 rotatably fixing the first guide roller to the edge folding guide rotatably. The extensions 46, such as a spring loaded boss, can be integrally molded with the first guide roller or separate elements spring loaded into recessors in the first guide roller 44 used in locking the edge folding guide 30 in place as hereinafter described.

Figure 6:
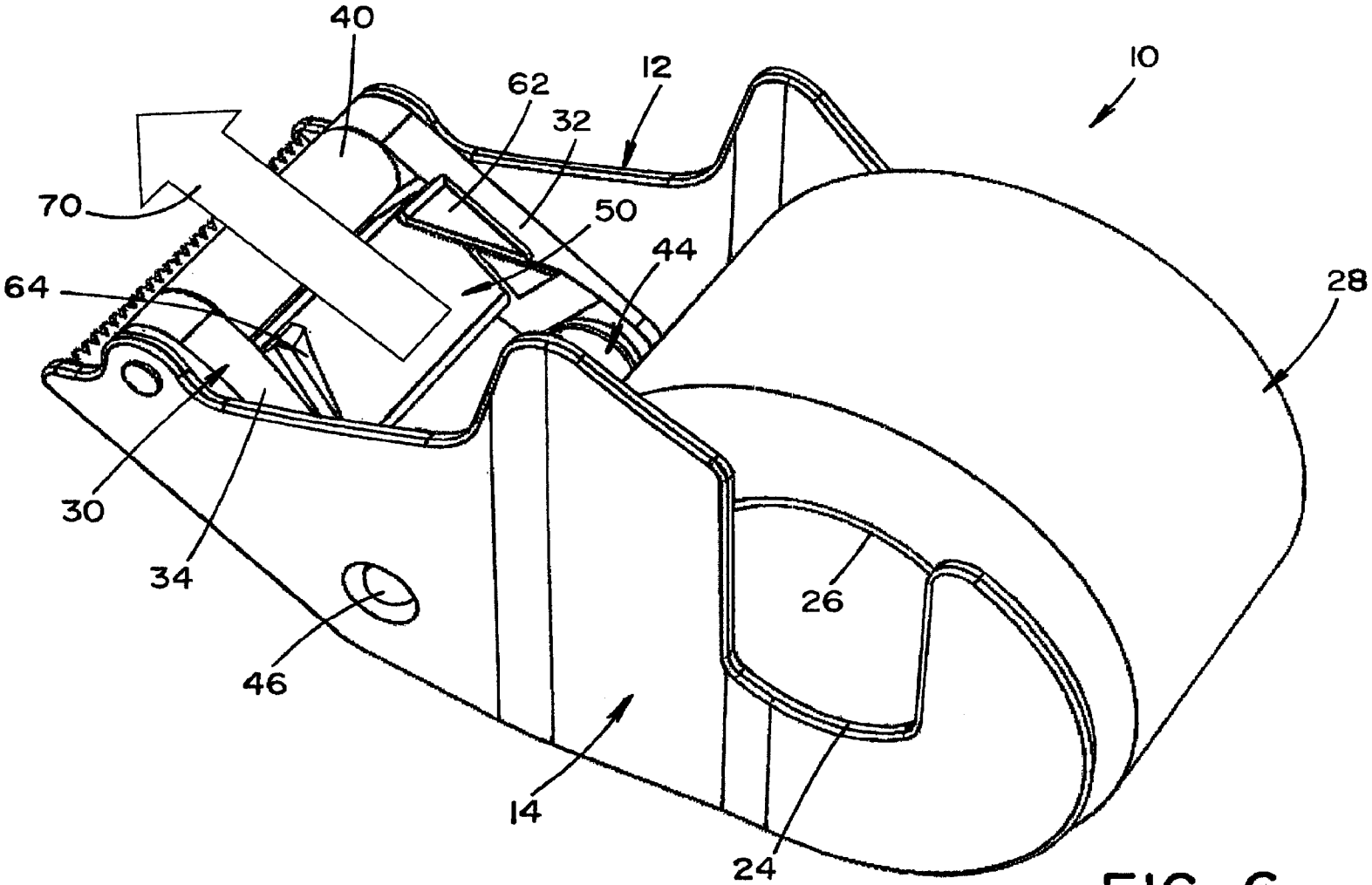
FIG. 6 is a view similar to FIG. 5 illustrating the next step in threading tape through the dispenser; and, FIG. 7 shows a top forward view of the tape dispenser of FIGS. 1-6 with the tape threaded through the dispenser and being applied to a workpiece with the longitudinal edges folded.

A web element 50 extends between the first side bar and the second side bar 34 adjacent the compression roller 40. There is a gap between the web element 50 and the compression roller 30. One side of the web element 50 presents a generally planar tape confronting surface 52 best seen in FIG. 5. The tape confronting surface 52 need not be flat. It can be slightly curved or textured or otherwise, so long as it guides the tape and constrains it to interact as described below. Referring again to FIG. 1, the inside surfaces, that is the surfaces facing one another, of the first side bar 32 and the second side bar 34 are further away from each other adjacent the first guide roller 44 when compared to the distance between these surfaces adjacent the compression roller 40. Thus, as also seen in FIG. 2, the inside surface of the first side bar 32 and the inside surface of the second side bar 34 form two inwardly facing surfaces generally perpendicular to the first generally planar tape confronting surface 52 which converge toward one another from the distal end of the edge folding guide 30 to the proximal end of the edge folding guide 30 when the edge folding guide 30 is in the configuration seen in FIG. 1. This gives the generally planer tape confronting surface 52 the shape of a trapezoid with a width at its wide end approximately the same as the width of the roll of tape to be dispensed and a narrower width at its narrow end closer to the cutter 18. Each side bar 32, 34 carries a guide member. The first guide member 62 extends inwardly from the first side bar 32 and the second guide member 64 extends inwardly from the second side bar 34. The guide members 62, 64 are integrally fabricated with the side bars 32, 34. The working surfaces of the guide members are fashioned to work with the generally planar tape confronting surface 52 and the inside surface of the first side bar and the inside surface of the second side bar 34 to fold over the edges of tape being dispensed. At the distal end of the generally planar tape confronting surface 52, the working surface of the guide members is spaced from the tape confronting surface and almost perpendicular to the tape confronting surface. The working surfaces of the guide members 62, 64 thereafter twist to gradually become more closely to parallel to the tape confronting surface 52 as the inside surfaces of the side bars 32, 34 converge. This twisting continues until the proximal end of the generally planar tape confronting surface 52 where the working surfaces of the guide members 62, 64 are almost parallel to the tape confronting surface 52 and define narrow slots. As a length of tape is pulled through this structure in the direction shown by the arrow 70 in FIG. 6, the edges of the tape are first forced to curl away from the tape confronting surface 52 as there is not sufficient width to accommodate the entire width of the tape. The working surfaces of the guide members 62, 64 then curl the edges of the tape so that the edges of the tape are first turned vertically and then into a confronting relationship with adjacent portions of the width of the tape. This continues to the proximal end of the tape confronting surface 52 wherein the edges of the length of the tape being dispensed are folded into proximity or contact with the next adjacent portions of the tape as seen in FIG. 1. The tape, with its edges folded over upon itself in a regular manner, is now ready for application to a workpiece and severing from the roll of tape by the cutter 18.

The above described dispense operation is available for dispensing lengths of tape for the entire length of tape contained upon the roll of tape 28. In this position, the extensions 46 of the first guide roller 44 extend through countersink holes in the side walls 12, 14 locking the edge folding guide 30 in the dispensing position.

It can be seen in FIG. 1 that the first guide roller 44 is crenelated or ridged. This reduces the surface area of the guide roller and allows the guide roller to interact with the adhesive bearing side of the roll of tape in dispensing operation. The tape is guided as required but is not adhesively bound to the guide roller so as to prevent dispensing.

While the first guide roller 44 is shown crenelated with circumferential ridges and grooves, other texturing of the guide roller may work as well. Thus, spiral ridges or rectangular feet and recesses would also work appropriately.

Figure 7:
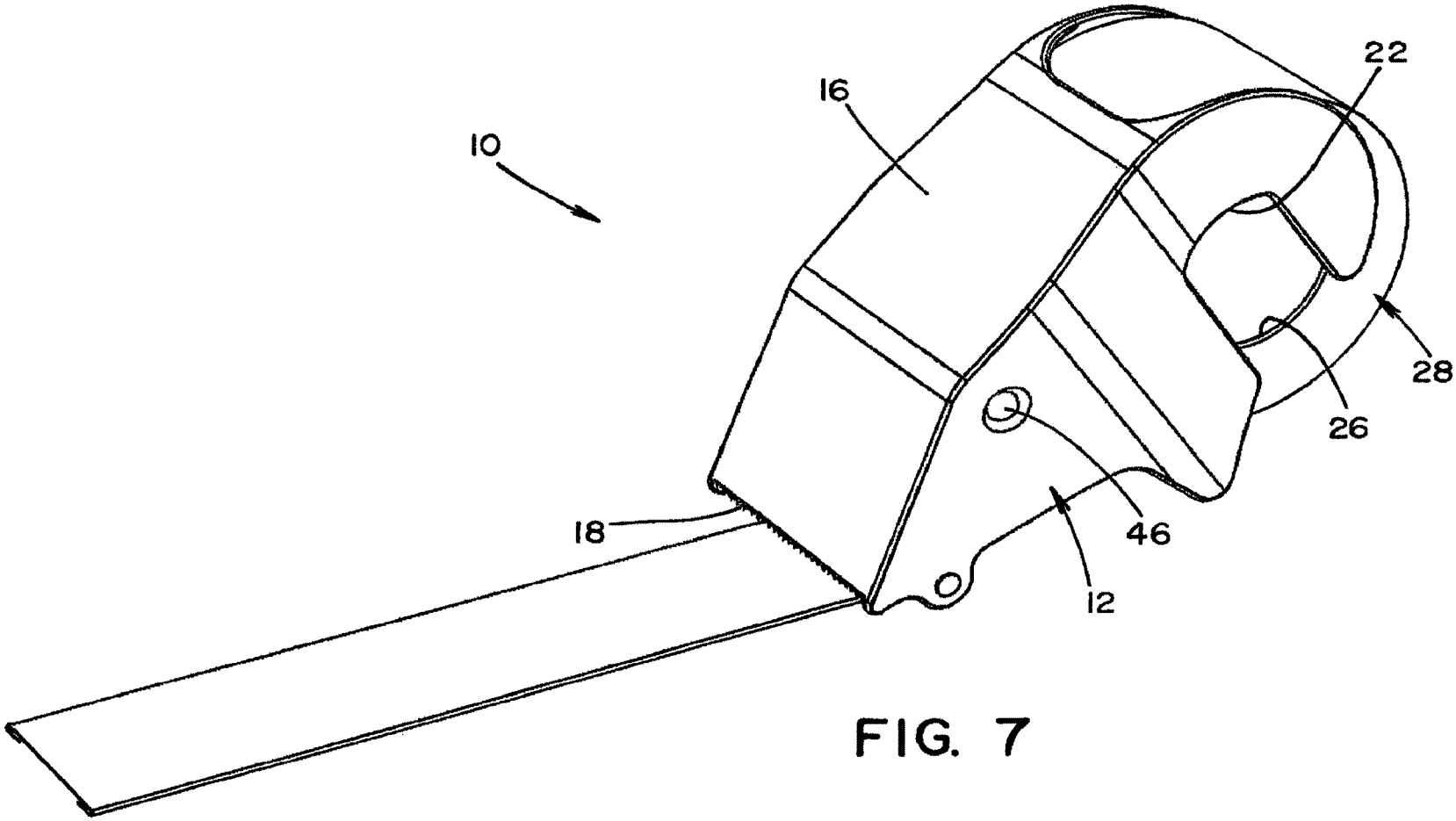

When a roll of tape is exhausted, the old core can be removed and a new roll of tape on a core placed between the first side wall 12 and the second side wall 14 with its tape core mounted on the first hub portion 22 and the second hub portion 24. Folding guide 30 is then unlocked from the side walls 12 and 14 by compressing the extensions 46 and the edge folding guide 30 is rotated into the threading positions seen in FIGS. 2 and 3. The end of the tape is then fed through the opening between the first guide roller 44 and the web element 50. The edge folding guide 30 is moved back into the dispense position The end of the tape is thus available to a user and can be pulled into engagement with the tape confronting surface 52, the inner surface of the side bars 32, 34, the guide members 62, 64 and the compression roll 40. The tape is now available for application to a workpiece in the configuration seen in FIGS. 1 and 7.

When a user has applied a length of tape to a workpiece and wishes to end the application, he turns the dispenser 10 upwardly engaging the tape with the cutter and cutting off the length of tape. A length of tape is thereby applied to the workpiece either to seal a container, temporarily join different workpieces, or mask a workpiece for painting. The advantages of a folded edge tape are thereby available for feather-edged painting, potentially increased tensile strength in sealing a box, and easy removal of the tape after use because the non-adhesive edges are available for grasping and removal of tape.

The above-described structures are symmetrically disposed about a plane situated half way between the first side wall and the second side wall. This provides the dispensing of tape having two folded side edges. The above-described structures can be modified by deleting the edge folding components on one side of the center line of the tape dispenser thereby folding only one edge of the tape. Thus, dispensers capable of folding one edge or both edges of a length of tape in dispensing are disclosed.

The width of the folded portion on each edge can be controlled by the shape of the tape confronting surface 52, the convergence of the inside surfaces of the side bars 32, 34 and the shape of the guide member 62, 64. Various widths of overlap can be provided. The overlaps can be identical on each edge of the tape or can be different sizes on one edge when compared to another.

The tape dispenser described has an overall appearance and operation very similar to existing tape dispensers for use with packaging tape and the like without folded edges. Thus, once the tape is threaded, the operation of the tape dispenser will be familiar to persons who have previously used hand held dispensers for non-folded edge tape. In addition, with reference to FIG. 2 a molded arrow 72 is provided in the underside of the web 50 indicating how to thread the tape when the edge folding guide 30 is in the threading position. Thus, the dispenser 10 is self-explanatory in both the application of tape and the threading of tape from a new roll of tape 28 into the dispenser.

The exemplary embodiment described above incorporates novel tape folding and novel tape threading structures into a conventional tape dispenser architecture. The novel tape edge folding and tape threading structures can be incorporated into other tape dispenser architectures without departing from the present disclosure. The disclosed structure and method, including the rotating edge folding guide, can be integrated into a pistol grip type or other type tape dispenser. Moreover, the tape edge folding and tape threading structures disclosed above will work in a tape dispenser using tape rolls with virtually any size core including those with internal diameters of 1.5 inches, 3 inches, and others. The tape edge folding and tape threading structures described above will work when integrated into a refillable type tape dispenser, an industrial pistol grip tape dispenser, and/or retail pistol grip tape dispenser. The tape edge folding and tape threading structures described above will work with any width of adhesive tape from 18 mm to 3 inches. Applicability to different types of tape is also supported in identical or slightly varying tape dispensers for use in sealing, strapping, filament strapping, binding and similar operations. The tape itself can be carton sealing tape, filament strapping tape, paper tape, duct tape, or other types of tape. The tape edge folding structure; and, the tape threading structure are reasonably integrated into any tape dispenser or tape applicator architecture or structure.

The exemplary embodiment has been described with reference to the preferred embodiment. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A handheld tape dispenser adapted to dispense lengths of adhesive tape having a generally uniform width, a pressure sensitive adhesive bearing surface and a non-adhesive surface from a roll of adhesive tape wound upon a core comprising a first side wall having a forward end, a rearward end, a top edge, and a hub portion near the rearward end;

a second side wall having a forward end, a rearward end, a top edge, and a hub portion near the rearward end;

a connecting portion extending between the first side wall and the second side wall and connecting the first side wall and the second side wall with the first side wall and the second side wall being generally parallel to one another;

a cutter adjacent the forward end of the first side wall and the forward end of the second side wall, the cutter adapted to separate a dispensed length of tape from the roll of adhesive tape;

an edge folding guide extending between and intersecting the first side wall and the second side wall, said edge folding guide having a first generally planar surface adapted to confront the non-adhesive surface of the lengths of adhesive tape, two inwardly facing surfaces generally perpendicular to the first generally planar surface, the two inwardly facing surfaces having ends proximal the cutter and distal the cutter and converging toward one another from the distal ends to the proximal ends; two guide members, one guide member adjacent to each inwardly facing surface; the guide members, the inwardly facing surfaces and the first generally planar surface defining guide slots adapted to engage the edges of the lengths of tape and fold the edges of the lengths of tape in longitudinal folds with portions of the pressure sensitive adhesive bearing surface confronting one another;

a guide roller extending between and intersecting the first side wall and the second side wall and oriented to engage the pressure sensitive adhesive bearing surface of said adhesive tape, said guide roller disposed between the rearward end of the tape dispenser and the edge folding guide; and a compression element between the guide slots and the cutter forming an exterior surface of the dispenser which engages only the non-adhesive surface of the tape and simultaneously applies pressure to the lengths of tape and a surface to which the tape is being applied and brings the confronting adhesive surface portions into contact.

2. The tape dispenser of claim 1 wherein the compression element is a roller.

3. The tape dispenser of claim 1 wherein the compression element is a wiper.

4. The tape dispenser of claim 1 wherein the first guide roller is crenelated.

5. The tape dispenser of claim 1 wherein the edge folding guide is rotatable with respect to the first side wall and the second side wall.

6. The tape dispenser of claim 5 wherein the edge folding guide has a first end where the guide roller is mounted and a second end remote from the first end where the compression element is mounted, said compression element being in rotational engagement with the first and second side walls such that the edge folding guide is rotatable with respect to the first side wall and the second side wall about a longitudinal axis of the compression element, whereby the edge folding guide may be rotated into a tape threading position in which the guide roller is at least substantially extended from the first and second side walls allowing a length of tape to be threaded into engagement with the first guide roller and made available to the guide slots and rotated into a dispensing position for dispensing lengths of tape with folded edges.

7. The tape dispenser of claim 6 wherein the edge folding guide may be releasably locked in the dispensing position.

8. The tape dispenser of claim 7 wherein the guide roller forms a locking element releasably engaging a recess on at least one of the first side wall and the second side wall.

9. The tape dispenser of claim 8 wherein the at least one locking element is a spring loaded boss disposed on said guide roller.

10. The tape dispenser of claim 9 comprising two spring loaded bosses, one provided at each end of the guide roller, the spring loaded bosses engaging apertures in the edge folding guide and releasably engaging recesses in the first side wall and second side wall, whereby the spring loaded bosses support the guide roller and releasably lock the folding guide in the dispensing position.

11. The tape dispenser of claim 1 wherein said first side wall and said second side wall are comprised of a polymer material.

12. A handheld tape dispenser adapted to dispense lengths of adhesive tape having a generally uniform width, a pressure sensitive adhesive bearing surface and a non-adhesive surface from a roll of adhesive tape wound upon a core comprising:

a first plastic side wall having a forward end, a rearward end, a top edge, and a hub portion near the rearward end;

a second plastic side wall having a forward end, a rearward end, a top edge, and a hub portion near the rearward end;

said hub portions comprising integrally molded projections upon which the core is mounted;

a plastic connecting portion extending between the first side wall and the second side wall and connecting the first side wall and the second side wall with the first side wall and the second side wall being generally parallel to one another;

a cutter adjacent the forward end of the first side wall and the forward end of the second side wall, the cutter adapted to separate a dispensed length of tape from the roll of adhesive tape;

an edge folding guide extending between and intersecting the first side wall and the second side wall, said edge folding guide having a generally planar surface adapted to confront the non-adhesive surface of the lengths of adhesive tape, at least one inwardly facing surface generally perpendicular to the first generally planar surface, said at least one inwardly facing surface having an end proximal the cutter and an end distal the cutter and converging toward a central plane between the first side wall and the second side wall from the distal end to the proximal end; a guide member adjacent to the inwardly facing surface; the guide member, the inwardly facing surface and the first generally planar surface defining a guide slot adapted to engage one of the edges of the lengths of tape and fold the edge of the lengths of tape in a longitudinal fold with portions of the pressure sensitive adhesive bearing surface confronting one another;

a guide roller extending between and intersecting the first side wall and the second side wall and oriented to engage the pressure sensitive adhesive bearing surface of said adhesive tape, said guide roller disposed between the rearward end of the tape dispenser and the edge folding guide; and a compression element between the guide slot and the cutter adapted to apply pressure to the lengths of tape bringing the confronting adhesive surface portions into contact; and said hand held tape dispenser having an orientation for tape application wherein the tape roll forms a lower surface and the compression element forms a lower surface such that the compression element engages only the non-adhesive surface of the tape and applies pressure to a non-adhesive bearing surface of the tape to cause said pressure sensitive adhesive bearing surface to contact an object to which said tape is being applied, and wherein said cutter is disposed above said compression element during tape application.

13. The tape dispenser of claim 12 wherein the compression element is a roller.

14. The tape dispenser of claim 12 wherein the compression element is a wiper.

15. The tape dispenser of claim 12 wherein the guide roller is crenelated.

16. The tape dispenser of claim 12 wherein the edge folding guide is rotatable with respect to the first side wall and the second side wall.

17. The tape dispenser of claim 16 wherein the edge folding guide has a first end where the guide roller is mounted and a second end remote from the first end where the compression element is mounted, said compression element being in rotational engagement with the first and second side walls such that the edge folding guide is rotatable with respect to the first side wall and the second side wall about a longitudinal axis of the compression element, whereby the edge folding guide may be rotated into a tape threading position in which the guide roller is at least substantially extended from the first and second side walls allowing a length of tape to be threaded into engagement with the first guide roller and made available to the guide slot and rotated into a dispensing position for dispensing lengths of tape with folded edges.

18. The tape dispenser of claim 17 wherein the edge folding guide may be releasably locked in the dispensing position.

19. The tape dispenser of claim 18 wherein the edge folding guide has at least one locking element releasably engaging a recess on one of the first side wall or the second side wall.

20. The tape dispenser of claim 19 wherein at least one locking element is a spring loaded boss.

21. The tape dispenser of claim 20 comprising two spring loaded bosses, one provided at each end of the first guide roller, the spring loaded bosses engaging apertures in the edge folding guide and releasably engaging recesses in the first side wall and second side wall, whereby the spring loaded bosses support the guide roller and releasably lock the folding guide in the dispensing position.

22. A method of threading an edge folding tape dispenser and dispensing tape comprising:

providing a roll of adhesive tape;

providing a tape dispenser having a first side wall having a forward end, a rearward end, a top edge, and a hub portion near the rearward end; a second side wall having a forward end, a rearward end, a top edge, and a hub portion near the rearward end; a connecting portion extending between the first side wall and the second side wall and connecting the first side wall and the second side wall with the first side wall and the second side wall being generally parallel to one another; a cutter adjacent the forward end of the first side wall and the forward end of the second side wall, the cutter adapted to separate a dispensed length of tape from the roll of adhesive tape; an edge folding guide having a first generally planar surface adapted to confront a non-adhesive surface of the adhesive tape, at least one inwardly facing surface generally perpendicular to the first generally planar surface, at least one inwardly facing surface having an end proximal the cutter and an end distal the cutter and converging toward a central plane between the first side wall and the second side wall from the distal end to the proximal end, a guide member adjacent to the inwardly facing surface; the guide member, the inwardly facing surface and the first generally planar surface defining a guide slot adapted to engage one of the edges of the adhesive tape and fold the edge of the adhesive tape in a longitudinal fold with portions of the adhesive bearing surface confronting one another; the edge folding guide being rotatable with respect to the first side wall and the second side wall about an axis adjacent its proximal end, and a guide roller being mounted on the edge folding guide adjacent its distal end; said guide roller providing releasable engagement with at least one of the first and second side walls and, a compression element between the guide slot and the cutter and rotatably secured to the first and second side walls and adapted to apply pressure to the lengths of tape bringing the confronting adhesive surface portions into contact;

rotating the edge folding guide about a longitudinal axis of the compression element and into a tape threading position by releasing the guide roller engagement with the side walls;

threading a length of tape from the roll of tape into engagement with the first guide roller and adjacent to the guide slot;

rotating the edge folding guide into a dispensing position for dispensing lengths of tape with folded edges; and grasping a top surface of said tape dispenser with a hand and applying the adhesive bearing surface of the tape to an object.

* * * * *